US006619920B1

(12) United States Patent
Cannon

(10) Patent No.: US 6,619,920 B1
(45) Date of Patent: Sep. 16, 2003

(54) ADJUSTABLE CEILING FAN BLADE COVER

(76) Inventor: Lisa A. Cannon, 13946 Charter Church Rd., DeSoto, MO (US) 63020

( * ) Notice: Subject to any disclaimer, the term of this patent is extended or adjusted under 35 U.S.C. 154(b) by 0 days.

(21) Appl. No.: 09/918,094

(22) Filed: Jul. 30, 2001

(51) Int. Cl.[7] ..... F04D 29/70
(52) U.S. Cl. ..... 416/62; 416/146 R; 150/158
(58) Field of Search ..... 416/5, 62, 146 R; 150/154, 158, 165

(56) References Cited

U.S. PATENT DOCUMENTS

| | | | | | |
|---|---|---|---|---|---|
| 4,526,280 | A | * | 7/1985 | Taylor | 150/154 |
| 4,832,572 | A | | 5/1989 | Prucha et al. | 416/146 R |
| 5,281,093 | A | | 1/1994 | Sedlak et al. | 416/62 |
| 5,516,264 | A | | 5/1996 | Anetrini | 416/62 |
| 5,564,900 | A | | 10/1996 | McAuley | 416/62 |
| 5,591,005 | A | | 1/1997 | McCready | 416/62 |
| 5,591,006 | A | | 1/1997 | DeMeo et al. | 416/62 |
| 6,019,479 | A | * | 2/2000 | Barker | 416/146 R X |
| 2002/0084011 | A1 | * | 7/2002 | Rochon | 150/154 X |

* cited by examiner

*Primary Examiner*—Edward K. Look
*Assistant Examiner*—Richard A. Edgar
(74) *Attorney, Agent, or Firm*—Grace J. Fishel

(57) ABSTRACT

A fan blade cover for overhead fans and the like may be made of a variety of sheet materials, such as cloth, paper, leather, plastic and laminates. The fan blade cover has an engagable and disengagable overlapping joint. The joint may have sufficient compliance to accommodate variations in the size and shape of individual fan blades. The fan blade cover may be plain or printed or otherwise decorated.

10 Claims, 3 Drawing Sheets

ADJUSTABLE CEILING FAN BLADE COVER

BACKGROUND OF THE INVENTION

1. Field of the Invention

The present invention relates to a removable cover for a fan blade with an engagable and disengagable overlapping joint to accommodate blades having a range of sizes and shapes.

2. Brief Description of the Prior Art

The blades of rotating fans are known to collect dirt and grime. Fans generally operate in an environment containing dust, lint and oils. This is especially true for overhead fans operating in kitchens, bedrooms and so forth. Heated air rises and carries with it dust, lint, oily vapors and similar materials. The fan blades pass through air containing this mixture and accumulate a layer of the materials on the surfaces of the fan blades.

It is often difficult to clean the fan blades of overhead fans. The fans may be installed at a height that makes them inconvenient to reach. Ladders or scaffolds may be required to reach the fans. Also, there is the difficulty of cleaning the blades from a ladder or scaffold. Removable fan blade covers have been proposed in the past to circumvent these difficulties, but each such cover has had a defect in design that discouraged its general use. The following patents are incorporated by reference herein and are illustrative of previous fan blade covers: U.S. Pat. No. 4,832,572, U.S. Pat. No. 5,281,093, U.S. Pat. No. 5,516,264, U.S. Pat. No. 5,564,900, U.S. Pat. No. 5,591,005 and U.S. Pat. No. 5,591,006.

BRIEF SUMMARY OF THE INVENTION

In view of the above, it is an object of the present invention to provide a removable fan blade cover with a compliant overlapping joint which can accommodate a range of fan blades having different sizes and shapes. Other objects and features of the invention will be in part apparent and in part pointed out hereinafter.

In accordance with the invention, a fan blade cover is provided with an overlapping joint which is readily engagable and disengagable. The overlapping joint provides sufficient compliance to accommodate the fan blade cover to variations in the width and shape of individual fan blades. This permits the fan blade covers to be made in relatively few sizes as each cover can be adjusted to provide a snug and aesthetically pleasing fit to a range of different fan blades.

The invention summarized above comprises the constructions hereinafter described, the scope of the invention being indicated by the subjoined claims.

BRIEF DESCRIPTION OF THE SEVERAL VIEWS OF THE DRAWING

In the accompanying drawings, in which several of various possible embodiments of the invention are illustrated, corresponding reference characters refer to corresponding parts throughout the several views of the drawings in which.

DETAILED DESCRIPTION OF THE INVENTION

Figure 1:
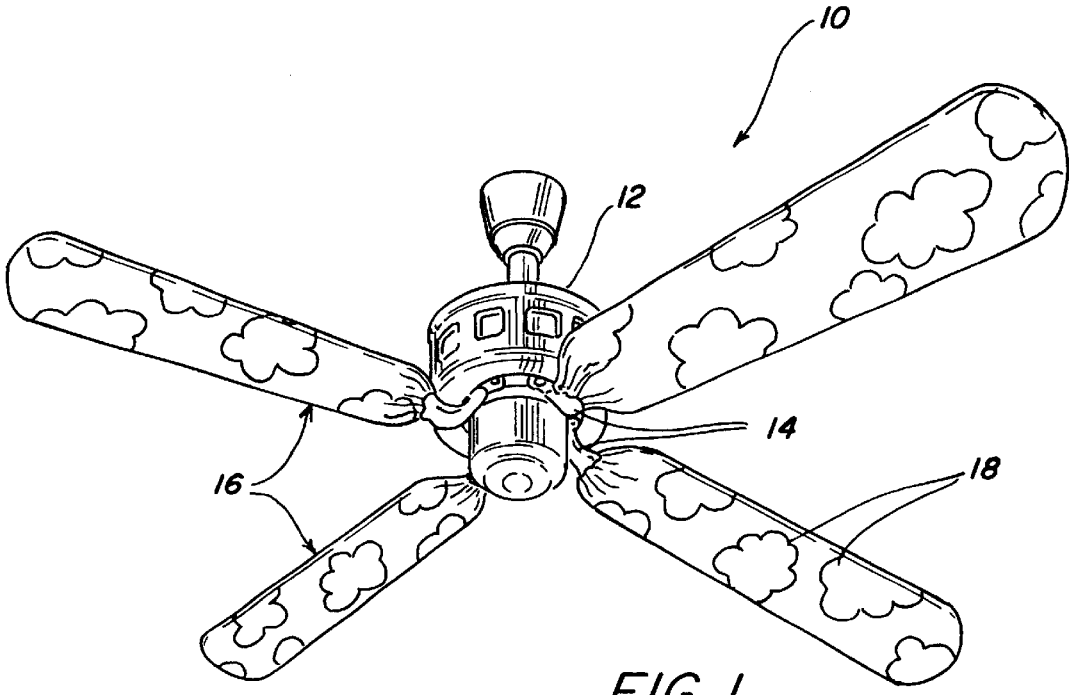
FIG. 1 is a bottom perspective view of an overhead fan having fan blade covers of the invention.
Figure 2:
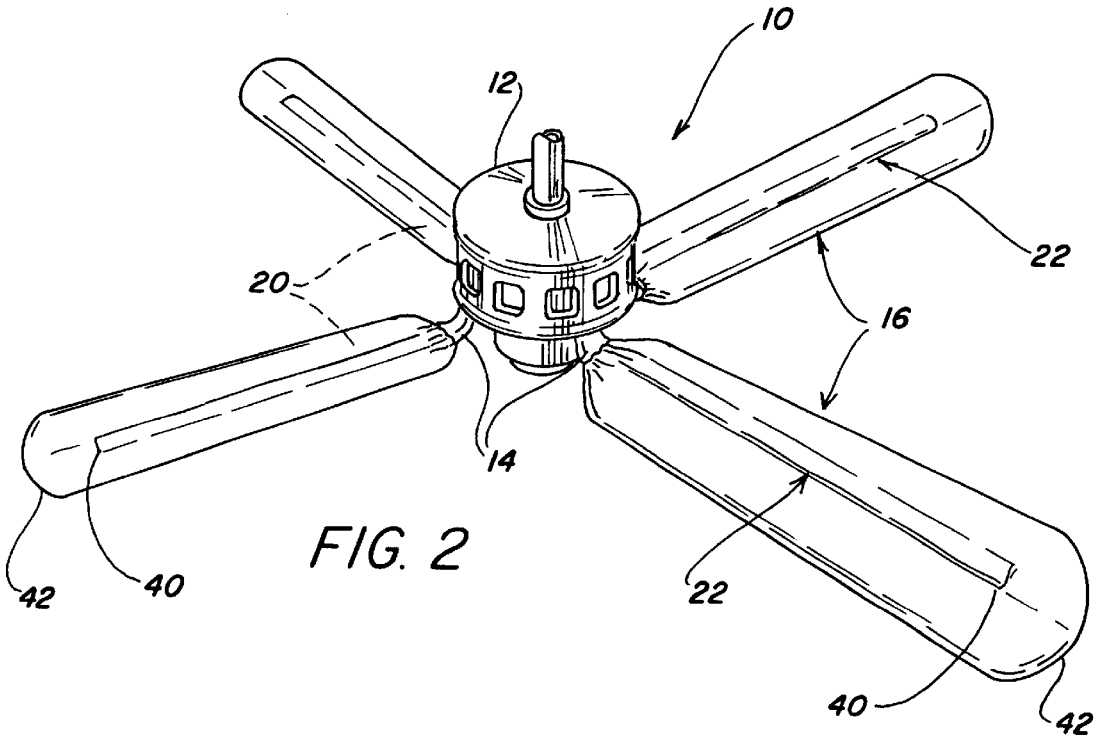
FIG. 2 is a top perspective view of an overhead fan having fan blade covers of the invention.

Referring to FIGS. 1 and 2, an overhead fan 10 is shown having an electric motor 12 and fan blades 14. Fan blades 14 are covered by fan blade covers 16 of this invention. As shown in FIG. 1, fan blade covers 16 are decorated with a floral pattern 18, but it will be appreciated that they may be plain or have any desired pattern or surface treatment. Fan blade covers 16 are formed of a sheet material, such as a fabric of woven, knit or felted construction. Other suitable sheet materials include leather, plastics such as polyvinyl chloride and laminates such sold under the trademark TYVEK. Various paper materials may also be used.

Figure 3:
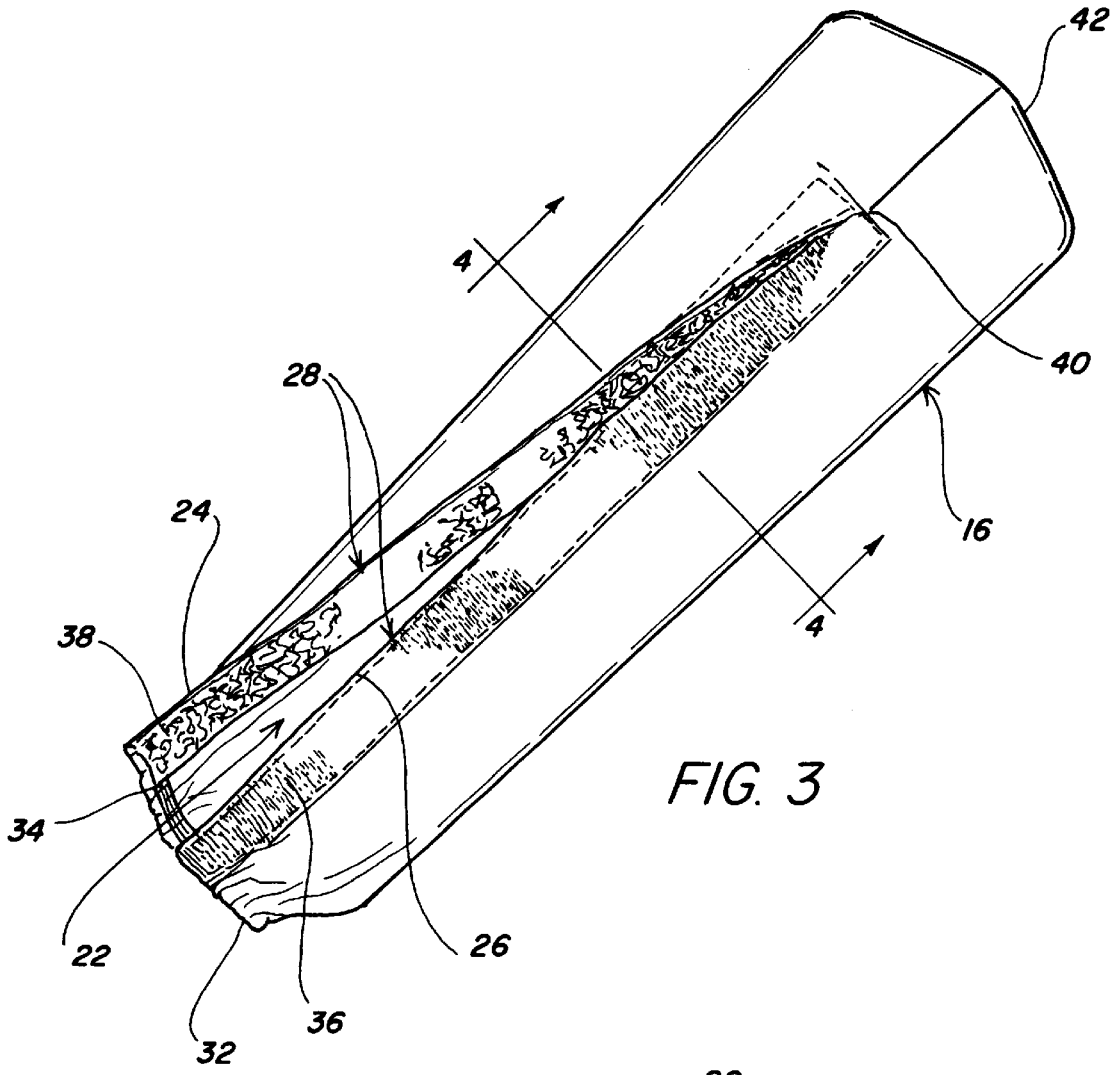
FIG. 3 is a top plan view of a fan blade cover of the invention.
Figure 4:
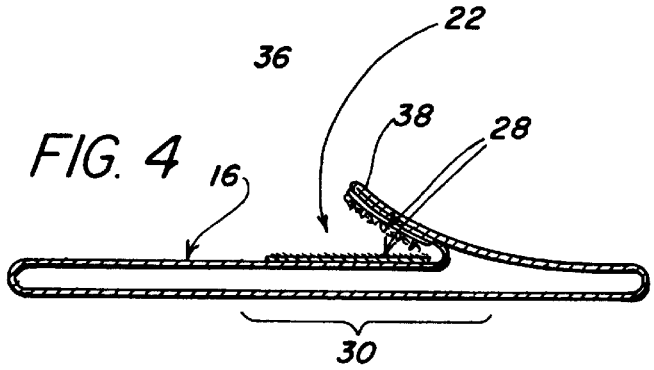
FIG. 4 is a cross sectional view of the fan blade cover of FIG. 3 taken along the plane 4—4.
Figure 5:
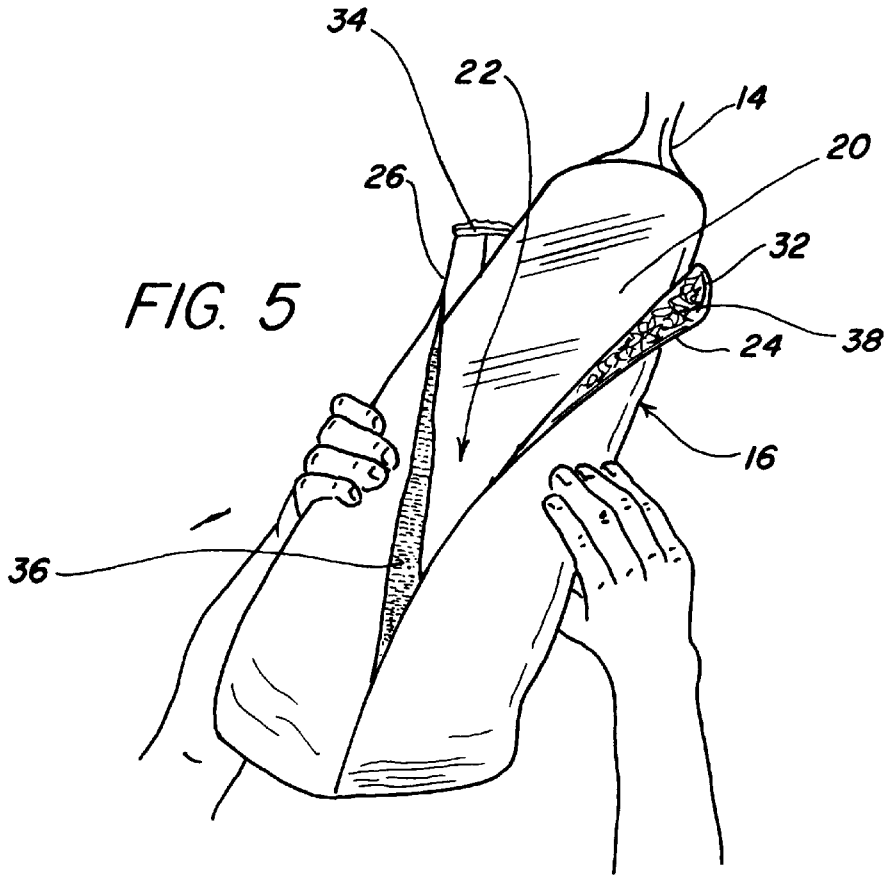
FIG. 5 is a perspective view of another embodiment of a fan blade cover of the invention, partially installed on a fan blade; and, FIG. 6 a perspective view of the embodiment illustrated in FIG. 5, fully installed on a fan blade.

As shown in FIGS. 2 and 5, fan blade covers 16 are placed around fan blades 14 and joined on back surfaces 20 thereof. Each of fan blade covers 16 has a longitudinally extending opening 22 in the sheet material. Longitudinally extending opening 22, best seen in FIGS. 3 and 4, extends substantially along the length of fan blade cover 16. Along longitudinally extending opening 22, the sheet material terminates at first and second edges 24, 26 (FIGS. 3 and 5). A selectively engagable and disengagable attachment means 28 (FIGS. 3 and 4) is provided at opening 22 forming a compliant overlapping joint 30 (FIG. 4). When compliant joint 30 is formed, one of first and second edges 24, 26 is exposed. A proximal end 32 of each fan blade cover 16 may also have an elastic band 34 (FIGS. 3 and 5) or a drawstring, not shown, to draw the cover into a snug attachment at a proximal end of fan blade 14. Alternatively, proximal end 32 may be tapered for snug attachment about the shoulders of fan blade 14.

With reference to FIGS. 3 and 4, overlapping compliant joint 30 may be formed with hook and loop fasteners 36, 38 such as those sold under the trademark VELCRO. The band of hook and loop fastener opposite the one of first and second edges 24, 26 that is exposed is wider than the other band of hook and loop fastener. By forming overlapping joint 30 with such bands of hook and loop fasteners 32, 34, one size fan blade cover 16 may be snugly installed on a variety of fan blades 14 having variations in width, cross-section and shape. A conventional overhead fan 10 has a blade length of forty-two and fifty-two inches. Fan blade cover 16 in only these lengths, and in each length produced with a nominal width of six inches and of five and one half inches, with overlapping compliant joint 30, fits many existing fans. This is a significant advantage, since a large inventory of different fan blade covers 16 is not required to accommodate many of the fans on the market.

It will be appreciated that other self-adjusting fastening materials may be used for overlapping compliant joint 30. For example, strippable adhesives which provide an engagable and disengagable connection may be used. Suitable candidates may be identified from adhesives used for a variety of industrial purposes, including the semi-permanent adhesives used on plastic film tape and the common removable adhesive note papers sold under the POST-IT trademark.

Figure 6:
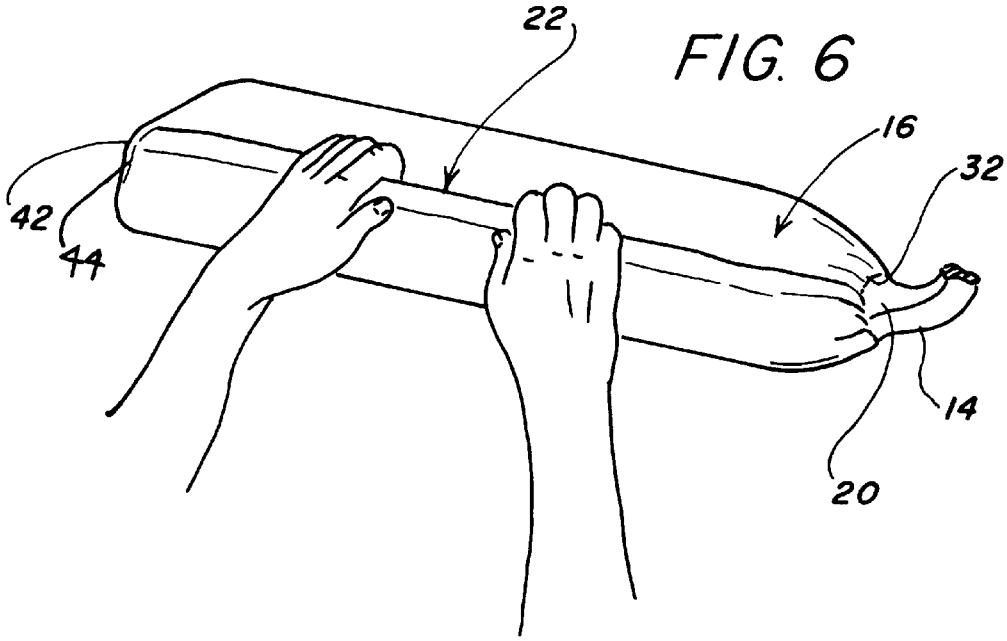

As shown in FIGS. 2 and 3, overlapping compliant joint 30 extends longitudinally along fan blade cover 16 and terminates at a point 40 on the fan blade cover 16 which is short of a distal end 42 of fan blade cover 16. The remaining portion of distal end 42 of fan blade cover 16 is preferably enclosed in this embodiment, forming a closed envelope structure. FIGS. 5 and 6 show an alternative embodiment of overlapping compliant joint 30 in which the joint extends to distal end 42 of fan blade cover 16. Overlapping compliant joint 30 may continue transversely along distal end 42 as shown in FIG. 5. Hook and loop fasteners 36, 38 may also be continued along distal end 42.

As shown in FIG. 4, hook and loop fasteners 36, 38, or strippable adhesive attachment, etc. may extend a substantial transverse distance 44 across the width of fan blade cover 16. The band of hook and loop fastener opposite the one of first and second edges 24, 26 that is exposed is wider than the other band of hook and loop fastener. This structure ensures that one of first and second edges 24, 26 is smoothly attached at overlapping compliant joint 30. This seals overlapping compliant joint 30 aerodynamically which reduces drag and noise and retains the integrity of the overlapping joint 30. The smooth attachment of the exposed one of first and second edges 24, 26 can be especially useful when fan blade covers 16 are used on reversible fans.

FIGS. 5 and 6 also show the method of installation of fan blade cover 16 on fan blade 14. With overlapping compliant joint 30 disengaged, fan blade cover 16 is placed on fan blade 14 by sliding engagement of fan blade cover 16 first onto the distal end of fan blade 14 and continuing along the full length of fan blade 14, much like sliding a glove onto a hand. When the full length of fan blade 14 is inserted into fan blade cover 16, overlapping compliant joint 30 is formed. As hook and loop fasteners 36, 38 are engaged to close overlapping compliant joint 30, fan blade cover 16 is pulled tight around the cross-section of fan blade 14 along the length of fan blade 14 to obtain a tight fit and accommodate any variation in the width of fan blade 14. As shown in FIG. 4, wide attaching elements 36, 38 (illustrated as hook and loop fasteners) provide sufficient compliance to obtain the desired fit. As shown in FIG. 6, when fully installed elastic band 34 assists in obtaining a close fit of fan blade cover 16 at the proximal end of fan blade 14. As will be appreciated, a dirty or used fan blade cover 16 may be removed by disengaging overlapping compliant joint 30 and reversing the above described process.

In view of the above, it will be seen that the object of the invention is achieved and other advantageous results attained. As various changes could be made in the above constructions without departing from the scope of the invention, it is intended that all matter contained in the above description or shown in the accompanying drawings shall be interpreted as illustrative and not in a limiting sense.

What is claimed:

1. A fan blade cover for encasing a fan blade, said fan blade cover having a body formed of a sheet material, the fan blade cover having a longitudinally extending opening in the sheet material, the longitudinally extending opening extending substantially along the length of the fan blade cover, the sheet material terminating at first and second edges at the opening, the first and second edges of the sheet material having a selectively engagable and disengagable attachment at the opening, the engagable and disengagable attachment providing a compliant continuous overlapping joint along the first and second edges of the sheet material whereby the fan blade cover may be snugly fastened around a fan blade and said engagable and disengagable attachment accommodating variations in the width and thickness and lateral shape of the fan blade over a predetermined range.

2. The fan blade cover of claim 1 wherein one of the first and second edges is exposed when the overlapping joint is attached and wherein the overlapping joint provides sufficient compliance to smoothly attach the exposed edge to the sheet material.

3. The fan blade cover of claim 1 wherein the engagable and disengagable attachment is a hook and loop fastener.

4. The fan blade cover of claim 1 wherein the engagable and disengagable attachment is an adhesive joint at the edges of the opening.

5. The fan blade cover of claim 1 wherein the fan blade cover has indicia thereon.

6. The fan blade cover of claim 1 wherein the sheet material of the fan blade cover is paper.

7. The fan blade cover of claim 1 wherein the fan blade cover has a proximal and a distal end and wherein the longitudinally extending opening extends from the proximal end to the distal end.

8. The fan blade cover of claim 7, wherein the proximal end of the fan blade cover has an elastic fastener thereon, whereby the proximal end of the fan blade cover may be snugly attached around a fan blade.

9. The fan blade cover of claim 7, wherein the longitudinally extending opening continues transversely around a portion of the distal end of the fan blade cover.

10. A fan blade cover for encasing the fan blades of overhead fans, the fan blade cover having a body formed of a sheet material, the fan blade cover having means for forming a longitudinally extending opening therein, the longitudinally extending opening extending substantially along the length of the fan blade cover, the longitudinally extending opening having means for forming a first free edge in the sheet material and a second edge in the sheet material, the first and second edges having means for selectively engagable and disengagable attachment to the opening and forming a compliant continuous overlapping joint when the fan blade cover is installed on a fan blade, the attachment means having means for smoothly attaching the first free edge of the sheet material to the fan blade cover, whereby the fan blade cover may be snugly fastened around a fan blade and the attachment means accommodates variations in the width and thickness and lateral shape of the fan blade.

* * * * *